US008241465B2

(12) United States Patent
Crook et al.

(10) Patent No.: US 8,241,465 B2
(45) Date of Patent: Aug. 14, 2012

(54) NON MARK SEAM FELT

(75) Inventors: Bob Crook, Wilson, NC (US); Clifton Wilder, Sims, NC (US)

(73) Assignee: Voith Patent GmbH, Heidenheim (DE)

( * ) Notice: Subject to any disclaimer, the term of this patent is extended or adjusted under 35 U.S.C. 154(b) by 414 days.

(21) Appl. No.: 12/544,516

(22) Filed: Aug. 20, 2009

(65) Prior Publication Data

US 2010/0043997 A1 Feb. 25, 2010

Related U.S. Application Data

(60) Provisional application No. 61/090,386, filed on Aug. 20, 2008.

(51) Int. Cl.
*D21F 7/08* (2006.01)
*D21F 7/10* (2006.01)

(52) U.S. Cl. ..... 162/358.2; 162/900; 162/904

(58) Field of Classification Search ..... 162/358.1, 162/358.2, 900, 904; 28/110, 142; 442/270; 139/383 AA
See application file for complete search history.

(56) References Cited

U.S. PATENT DOCUMENTS

| | | | | |
|---|---|---|---|---|
| 5,601,877 | A * | 2/1997 | Miller et al. | 427/373 |
| 6,176,271 | B1 | 1/2001 | Sayers et al. | |
| 6,712,100 | B2 * | 3/2004 | Yook et al. | 139/383 A |
| 2002/0115368 | A1 | 8/2002 | Yook | |
| 2007/0155269 | A1 * | 7/2007 | Patel et al. | 442/149 |
| 2008/0092980 | A1 * | 4/2008 | Wilson | 139/383 AA |
| 2008/0190580 | A1 | 8/2008 | Crook | |

FOREIGN PATENT DOCUMENTS

EP 0 695 827 A2 2/1996

OTHER PUBLICATIONS

European Search Report EP09166665 dated Sep. 30, 2009.

* cited by examiner

*Primary Examiner* — Eric Hug
(74) *Attorney, Agent, or Firm* — Taylor IP, P.C.

(57) ABSTRACT

A press felt for use in a paper, cardboard or tissue machine, with an open, load-carrying base structure which, viewed in longitudinal direction of the press felt, includes seam loops on one end, as well as seam loops at the other end, whereby the seam loops on the one end and the ones on the other end can be brought together for the purpose of producing the endless press felt and can be intermeshed with each other, so that a pass through opening is created through which a pintle can be guided, and comprising a machine side fibrous nonwoven structure which is located on the base structure and which provides the machine side of the press felt and which, viewed in longitudinal direction of the press felt, has one end section and one other end section, whereby when viewed in longitudinal direction of the press felt, the seam loops respectively extend at least partially over the end sections of the machine side fibrous nonwoven structure. In at least one end section of the machine side fibrous nonwoven structure an elastomeric polymer material is provided which is formed from a polymer or pre-polymer which was added in liquid form into the press felt and subsequently solidified or cured and which extends in the at least one end section from the machine side fibrous nonwoven structure into the base structure.

21 Claims, 1 Drawing Sheet

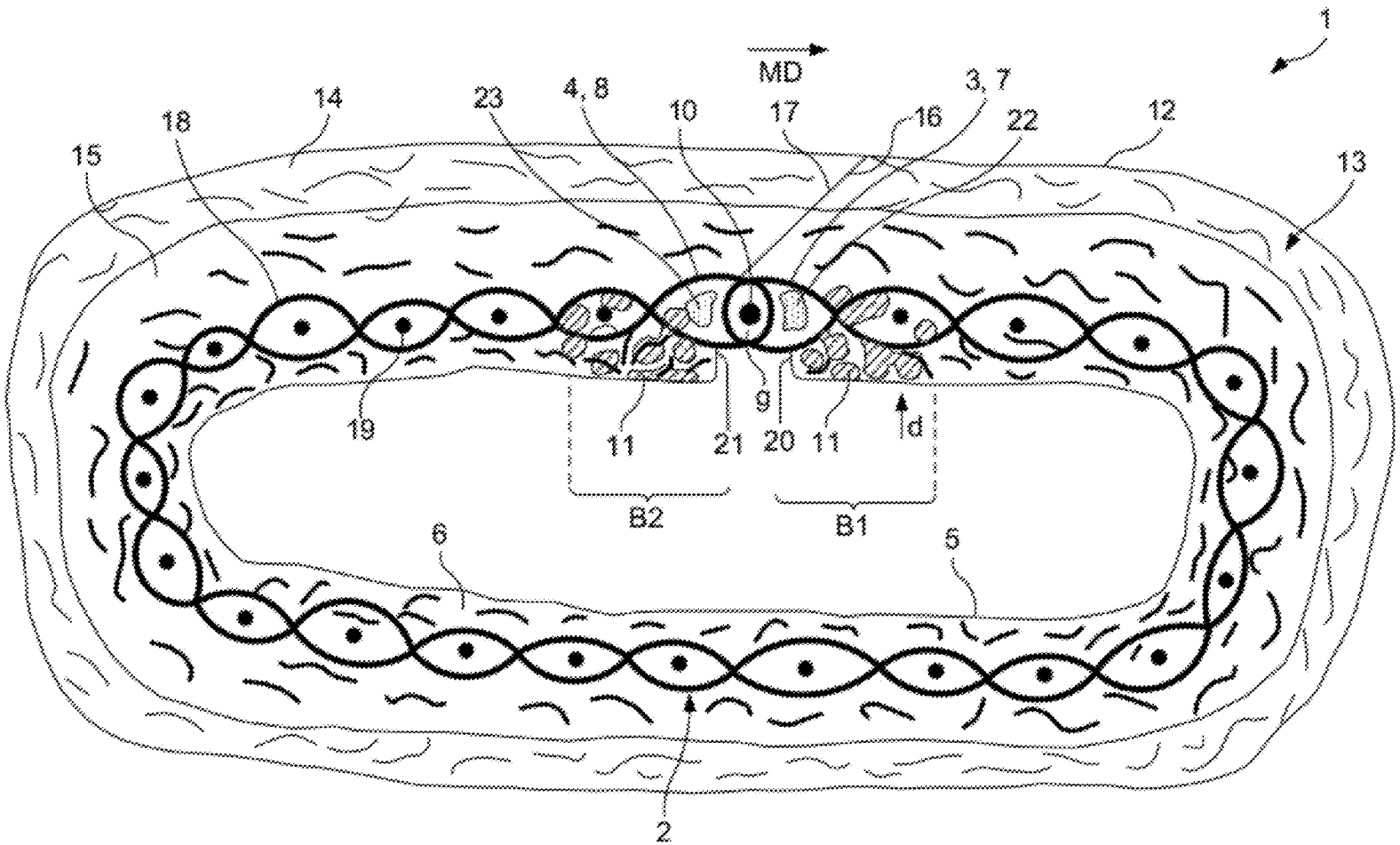
1
13
12
3, 7
22
16
17
MD
10
4, 8
23
14
18
15
19
9
21
20
11
11
B2
B1
d
5
6
2

NON MARK SEAM FELT

This is a non-provisional application based upon U.S. provisional patent application Ser. No. 61/090,386 entitled "NON MARK SEAM FELT", filed Aug. 20, 2008, which is incorporated herein by reference.

BACKGROUND OF THE INVENTION

1. Field of the Invention

The present invention relates to a press felt for a paper, cardboard or tissue machine, which can be made endless by means of pintle wire in the machine.

2. Description of the Related Art

Seamable press felts, or those that can be made endless, have always presented a problem in the paper machine with regard to an increased tendency to mark in the seam region. An additional problem with seamable press felts in the paper machine, or those that can be made endless, exists in the increased wear and tear which is based on the loss of fibers in the machine-side fibrous nonwoven layer in the region of the seam. On the press felts known from the current state of the art it has been suggested to add additional polymer material over the seam in order to increase the wear resistance. This additional polymer material is supplied from the paper side of the felt and oftentimes saturates the felt through its entire thickness. A great disadvantage is the marking characteristic associated with it due to the water and air permeability in the seam region caused by it, as opposed to the areas outside the seam region.

What is needed in the art is a press felt which, in spite of increased wear resistance compared to the press felts known in the state of the art, has the same or improved marking characteristic.

SUMMARY OF THE INVENTION

A press felt is provided for use in a paper, cardboard or tissue machine, whereby the press felt has one manufactured open, load-carrying base structure. The base structure of the press felt of the present invention, viewed in longitudinal direction, has seam loops on one end, as well as seam loops located at a distance from these, at the other end. The seam loops on the one end and the seam loops on the other end can be brought together for the purpose of producing the endless press felt and can be intermeshed with each other, so that a pass through opening is created through which a pintle can be guided. The press felt of the present invention further includes a fibrous nonwoven structure, which is located on the base structure and which provides the machine side of the press felt. Viewed in longitudinal direction of the press felt, the machine side fibrous nonwoven structure has one end section and another end section, located at a distance from the one end section. Viewed in a longitudinal direction of the press felt of the present invention, the seam loops on the one end, and those on the other end, respectively, extend at least partially over the end sections of the machine side fibrous nonwoven structure.

On the press felt of the present invention, an elastomeric polymer material is additionally provided on at least one end section of the machine side fibrous nonwoven structure which is formed from a polymer or pre-polymer that was supplied in a liquid form into the press felt and was subsequently solidified or cured. Viewed in a longitudinal direction of the press felt, the elastomeric polymer material extends at least in sections in the at least one end section, and viewed in the direction of the thickness of the press felt, extends from the machine side fibrous nonwoven structure into the base structure.

The two end sections of the machine side fibrous nonwoven structure extend, respectively, only over a part of the length of the machine side fibrous nonwoven structure. The two end sections further limit the machine side fibrous nonwoven structure in its length. The seam loops on the one end and those on the other end further limit the base structure in its length.

The elastomeric polymer material may hereby be located only on at least one end of the machine side fibrous nonwoven structure, or, viewed in a longitudinal direction of the press felt, may extend totally or partially in the at least one end section. Viewed in a longitudinal direction of the press felt, the elastomeric polymer material may also extend beyond the at least one end section.

An elastomeric polymer material is supplied into the locations at the seam region which are responsible for anchoring of the fibers of the machine side fibrous nonwoven layer into the base structure in the region of the seam. This results in a press felt having a clearly increased wear resistance. The elastomeric polymer material does not extend into the pass through opening created by the seam loops.

It is also conceivable that the elastomeric polymer material—viewed in a longitudinal direction of the press felt is provided on both end sections of the machine side fibrous nonwoven structure and hereby does not extend into the pass through opening created by the seam loops.

Viewed in a longitudinal direction of the press felt, the elastomeric polymer material extends only in the at least one end section or only in the two end sections. This results in that—viewed in a longitudinal direction of the press felt—between the two end sections, a section of the machine side fibrous nonwoven structure is formed, in which no elastomeric polymer material that was supplied in liquid form is located. This means, that essentially, an elastomeric polymer material is supplied only at those locations in the seam region which are responsible for anchoring the fibers of the machine side nonwoven layer into the base structure in the region of the seam. Due to the small length relative to the length of the press felt of the at least one end section or the two end sections of the machine side fibrous nonwoven layer which is, or respectively are, impregnated with the polymer material, the tendency toward marking caused through the polymer material is not, or is only slightly, increased.

A first embodiment of the present invention provides that the elastomeric polymer material, viewed in longitudinal direction of the press felt, extends in the at least one end section over a length of up to approx. 2 inches, to approx. 1 inch, to approx. ½ inch, or to approx. ¼ inch. It is also conceivable that the elastomeric polymer material extends over a length of at least 1/32 inch, for example, over 1/16 inch. Viewed in a longitudinal direction of the press felt, the elastomeric polymer material extends in the two end sections, both over a length to approx. 2 inches, to approx. 1 inch, to approx. ½ inch, or to approx. ¼ inch. The polymer material is supplied into the press felt at a volume in the range of $50/g^2$ to 500 $g/m^2$.

Since the press felt—when used as intended in the paper, cardboard or tissue machine-moves along a transport direction parallel to the longitudinal direction of the press felt, the at least one end section into which the elastomeric polymer material is added is the back one of the two end sections, viewed in transport direction. In addition, the elastomeric polymer material is located on the entire width of the press felt. In other words, the elastomeric polymer material forms a stripe which extends transversely to the longitudinal direction of the press felt across the entire width of the press felt. In this instance, it is conceivable that the elastomeric polymer material extends continuously, or intermittently across the entire width of the press felt. In the latter instance the elastomeric polymer material forms several segments located successively across the width of the press felt. The base structure is, for example, needle bonded with the machine side fibrous nonwoven structure.

A second embodiment of the present invention provides that a paper side fibrous nonwoven structure is provided on the base structure, providing the paper side of the press felt. The paper side fibrous nonwoven structure is also, for example, needle bonded with the base structure. The machine side and/or paper side fibrous nonwoven structure can be composed of at least one fibrous nonwoven layer.

Viewed in a longitudinal direction of the press felt of the present invention, the paper side fibrous nonwoven structure has one end section on one side and one other end section on the other side, whereby the two end sections of the paper side fibrous nonwoven structure in a created endless condition of the press felt abut each other and one of the two end sections of the paper side fibrous nonwoven structure, viewed in longitudinal direction of the press felt, overlaps the pass through opening. This means that the paper side fibrous nonwoven structure extends especially along the entire length of the press felt, and one end section of the paper side fibrous nonwoven structure bridges the pass through opening.

The fibers on the machine side fibrous nonwoven structure and the threads of the base structure are embedded, at least partially, into the elastomeric polymer material. The anchoring of the machine side fibrous nonwoven structure into the base structure is further improved due to at least partial embedding of the fibers and threads into the elastomeric polymer material.

Additionally, the elastomeric polymer material at the at least one end section of the machine side fibrous nonwoven structure may partially fill and/or bridge spaces which are formed between the fibers of the machine side fibrous nonwoven structure and/or between threads of the base structure and/or between fibers of the machine side fibrous structure and threads of the base structure. This results in that a composite structure, which is created from the elastomeric polymer material and fibers and/or threads, is permeable, meaning that the permeability of the press felt in the seam region is not negatively influenced.

In order to improve the elasticity of compression and the damping characteristic in the seam region, the elastomeric polymer material can have a foam structure, for example, a closed cellular foam structure. This is possible, for example, if during production of the liquid polymer or pre-polymer, $CO_2$ is added which forms gas bubbles in the cured polymer material, or whereby $CO_2$ occurs in the hardening reaction.

The base structure may include longitudinal threads and cross strengthening elements joined with these. The seam loops can hereby be formed by the longitudinal threads, whereby the longitudinal threads are not joined with the cross strengthening elements in the region of the seam loops are but, however, joined in the region outside the seam loops. The longitudinal threads forming the seam loops may be monofilament threads, thereby clearly simplifying the insertion of the pintle wire through the pass through opening that is formed by the seam loops.

The cross strengthening elements may be formed, for example, by cross threads, whereby the cross threads can, for example, be multifilament threads. If the base structure is formed, for example, by a woven structure of longitudinal threads and cross threads, then the longitudinal threads are not interwoven with the cross threads in the region of the seam loops, whereas outside of the seam loops the longitudinal threads are interwoven with the cross threads. The cross threads and the longitudinal threads of the base structure can be formed from polyamide or may include polyamide.

Viewed in longitudinal direction of the press felt of the present invention, at least one additional filler thread, which extends parallel to the cross threads and which differs in structure and/or material from the cross threads, is located between the cross threads which are interwoven with the longitudinal threads and the pass through opening which is created by the seam loops. This filler thread is composed of two components, namely one first and one second component, whereby the first component has a greater strength, especially with regard to shear forces, than the second component and whereby the second component has a lower melting temperature than the first component. The first component may, for example, be PA with a strength of more than 30 g/tex. The second component may, for example, be a co-polyamide with a melting temperature in the range of approx 100-140° C.

At least one filler thread is inserted before the paper side and the machine side fibrous nonwoven structure is needle bonded with the base structure. This results in that the fibers of both fibrous nonwoven structures are needled into the at least one filler thread. To further secure the at least one filler thread the at least one filler thread is embedded, at least partially, into the elastomeric polymer material. The elastomeric polymer material consists of a moisture-hardening pre-polymer, which is supplied in liquid form and subsequently hardens or cures during cross-linking.

The elastomeric polymer material can hereby contain polyurethane or polycarbamide, or may be composed of these materials. A moisture-hardening pre-polymer has the advantage that it does not contain solvents and that it cross-links through the reaction with surrounding moisture. In addition, a moisture-hardening pre-polymer can be supplied immediately after installation of the felt in the machine. Polycarbamide has the advantage that it forms an extremely tight bond with threads and fibers that are formed from polyamide, whereby the fibers and/or threads of the machine side fibrous nonwoven structure or base structure which are embedded at least partially into the polycarbamide are bonded extremely tightly to the polycarbamide which, in turn, affects the wear properties of the press felt of the present invention very positively.

It is also conceivable to use a moisture-hardening polyurethane as pre-polymer. Moisture-hardening pre-polymers are pre-polymers with isocyanate groups, whereby the pre-polymers can again be produced from di-isocyanates and diamine or from di-isocyanates and diolene. To produce suitable pre-polymers, MDI or polymeric MDI are to be considered. The diolenes and diamines are, for example, polytetrahydrofuranes, polybutene-oxide, polypropylene-oxide, polyethylene-oxide with hydroxyl or amino end groups. If diolenes are used for the production of the pre-polymer, the completed cured polymer contains compounds of carbamide and urethane. If diamines are used for the production of the pre-polymer, then essentially only carbamide groups occur during the curing of the pre-polymer.

Curing of the moisture-hardening pre-polymer occurs at a temperature in the range of 20° C. to 80° C. To accelerate the hardening process, the moisture-hardening pre-polymer can be subjected to a steam- or water treatment. If the press felt of the present invention is drawn into the paper machine with only partially cured pre-polymer, then the complete hardening of the pre-polymer and the formation of the polymer material is accelerated in the paper machine, due to the moist surroundings prevailing there.

The pre-polymers can be diluted with solvent in order to regulate the suitable viscosity necessary for feeding into the base structure and/or fibrous nonwoven structure. A suitable solvent for this is, for example, tetrahydrofurane. To accelerate the hardening of the pre-polymer, suitable catalysts, for example, di-morpholine diethyl ether or metal catalyst can be used. The isocyanate share in the pre-polymers utilized in the present invention is approximately between 3 weight % and 30 weight %, for example, between 6 weight % and 16 weight %.

The polymer which is fed into the press felt in a liquid state can, for example, also be in the form of polymer particles which are present in an aqueous dispersion. It is also conceivable that the polymer material is dissolved in a solvent. Two-component polyurethane or polycarbamide can also conceivably be used.

It is also conceivable that an additional elastomeric polymer material is fed into the paper side fibrous nonwoven structure which, viewed in longitudinal direction of the press felt, extends at least in the region of one of the two end sections of the paper side fibrous structure, but does not, however, extend into the pass through opening which is formed by the seam loops. In this case, viewed in longitudinal direction of the press felt, the additional elastomeric polymer material may extend in the region of the at least one end section to a length of approx. 1/16 inch to approx. 1/4 inch, for example, approx. 1/16 inch to approx. 1/2 inch.

The additional elastomeric polymer material can be the same polymer material as the elastomeric polymer material, which is supplied into the machine side fibrous nonwoven structure. In this case, for example, with a paper side fibrous nonwoven structure, which is composed of several fibrous nonwoven layers, the additional elastomeric polymer material may be added to a paper side fibrous nonwoven layer which is already located on the base structure, before an additional paper side fibrous nonwoven layer which provides the paper side of the press felt is placed on the already positioned paper side fibrous nonwoven layer.

In order to prevent increased marking due to the additional elastomeric polymer material, the additional elastomeric polymer material, viewed in direction of thickness of the press felt, does not extend through to the paper side of the press felt. Hereby, the polymer material in the paper side fibrous nonwoven structure, for example, in the region of the seam loops, does not extend to the paper side.

The following procedure may, for example, be followed in the production of the press felt of the present invention.

A load carrying and open manufactured base structure is provided which, viewed in a longitudinal direction of the press felt, has seam loops on one end, as well as seam loops on the other end which, in order to produce an endless press felt, can be brought together and intermeshed to produce a pass through opening through which a pintle wire can be inserted. On one side of the base structure a machine side fibrous nonwoven structure is provided which represents the machine side of the press felt that is to be produced and which, viewed in its longitudinal direction, has an end section on one side, as well as on the other side. The machine side fibrous nonwoven structure is oriented with regard to its longitudinal direction parallel to the longitudinal direction of the base structure and placed on the base structure so that the seam loops on the one end of the base structure extend beyond the one end of the machine side fibrous nonwoven structure, and the seam loops on the other end of the base structure extend beyond the other end of the machine side fibrous nonwoven structure. The longitudinal direction of the press felt is determined by the longitudinal direction of the base structure and that of the machine side fibrous nonwoven structure. A paper side fibrous nonwoven structure representing the paper side is provided on the opposite side of the base structure. The machine side fibrous nonwoven structure, the paper side nonwoven structure and the base structure are joined with each other, for example, through needle bonding. A liquid polymer or pre-polymer is added from the direction of the machine side into the machine side fibrous nonwoven structure, at least on one of its end sections, in a manner that it extends in the at least one end section from the machine side fibrous nonwoven structure into the base structure. After adding the liquid polymer or pre-polymer, this is cured to form an elastomeric polymer material. The addition of the polymer or pre-polymer occurs hereby in such a way that the polymer material does not extend into the pass through opening which is created by the seam loops.

It would, however, also be conceivable to add the liquid polymer or pre-polymer during a half-finished state of the press felt in the region of at least one end of the machine side fibrous structure from the direction of the base structure in such a way that it extends from the machine side fibrous nonwoven structure into the base structure. A pipette or syringe may, for example, be used to add the liquid polymer or pre-polymer.

It is conceivable in this context that the liquid polymer or pre-polymer is added before insertion of the pintle wire into the passage opening or after its insertion. It is also conceivable that the liquid polymer or pre-polymer is added after the press felt is drawn into the paper machine.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 illustrates an endless press felt viewed in the MD direction.

Corresponding reference characters indicate corresponding parts throughout the several views. The exemplification set out herein illustrates an embodiment of the invention, in one form, and is not to be construed as limiting the scope of the invention in any manner.

DETAILED DESCRIPTION OF THE INVENTION

Referring now to the drawing and, more particularly to FIG. 1, there is shown a view of press felt 1 for a paper, cardboard or tissue machine, in its created endless state, in longitudinal MD direction of press felt 1. Press felt 1 has a load carrying and open manufactured base structure 2 which, in the present example, is formed, for example, by a woven structure. In the present example, the woven structure is formed by longitudinal threads 18 and with cross threads 19 which are interwoven with them. Any other type of load carrying base structure, for example, a laid thread structure with spiral link longitudinal threads is conceivable.

Viewed in longitudinal direction MD of press felt 1, base structure 2 is defined by one end 3 and by another end 4, whereby the one end is formed by first seam loops 7 and other end 4 by second seam loops 8. In the present example, seam loops 7, 8 are formed by longitudinal threads 18, whereby longitudinal threads 18 are not interwoven with cross threads 19 in region of the seam loops 7, 8.

Press felt 1 further comprises machine side fibrous nonwoven structure 6, which provides machine side 5 of press felt land which is located on base structure 2. Machine side fibrous nonwoven structure 6, viewed in longitudinal direction of the press felt, is defined by first end 20 and second end 21.

As can be seen from the depiction in the drawing, machine side fibrous nonwoven structure 6 is placed on base structure 2 in such a way, and joined with it so that, viewed in longitudinal direction MD of press felt 1, first seam loops 7 extend beyond first end 20 of fibrous nonwoven structure 6 and second seam loops 8 extend beyond second end 21 of fibrous nonwoven structure 6. In other words, this means that machine side fibrous nonwoven structure 6, viewed in longitudinal direction MD of press felt 1 does not extend into the region of pass through opening 9 which is formed by seam loops 7, 8.

In the current example, press felt 1 has been made endless in that first and second seam loops 7, 8 are brought together in such a way that they intermesh, thereby creating a pass through opening 9 which extends across the width of press felt 1 and through which the pintle wire is inserted.

In addition, elastomeric polymer material 11 is provided which, viewed in the direction of thickness d of press felt 1, extends from machine side fibrous nonwoven structure 6 into base structure 2 and which, viewed in longitudinal direction MD of press felt 1, is located on both ends 20, 21 of machine side fibrous nonwoven structure 6, but not in the region of passage opening 9, which is created by seam loops 3, 4.

The elastomeric polymer material 11, which was created from a liquid polymer or pre-polymer, was added from machine side 5 into machine side fibrous nonwoven structure 6. Moreover, fibers of machine side fibrous nonwoven structure 6 and threads 18, 19 of base structure 2 are embedded, at least partially, into elastomeric polymer material 11. In end section B1 comprising one end 20 of the machine side fibrous nonwoven structure, elastomeric polymer material 11 hereby partially fills and/or bridges spaces which are formed between fibers of machine side fibrous nonwoven structure 6 and/or between threads 18, 19 of base structure 2, so that the composite structure which is created in end section B1 and which is composed of fibers, threads 18, 19 and elastomeric polymer material 11 is permeable. Moreover, in end section B2, comprising other end 21 of the machine side fibrous nonwoven structure, elastomeric polymer material 11 hereby partially fills and/or bridges spaces which are formed between fibers of machine side fibrous nonwoven structure 6 and/or between threads 18, 19 of base structure 2, so that the composite structure which is created in end section B2 and which is composed of fibers, threads 18, 19 and elastomeric polymer material 11 is permeable.

Threads 18, 19 of base structure 2 can be polyamide or at least include polyamide. It is, however, also conceivable that at least the fibers of machine side fibrous nonwoven structure 6 are polyamide, or at least include polyamide. The elastomeric polymer material was formed in that a liquid and moisture-hardening pre-polymer was added from machine side 5 into press felt 1 and was subsequently cured.

In order to influence the structure of the press felt as little as possible in regard to marking tendency related to improved wear resistance, elastomeric polymer material 11 is located only in end sections B1, B2 of two ends 20, 21 of machine side fibrous nonwoven structure 6. End sections B1, B2, viewed in longitudinal direction MD of press felt 1, extend hereby preferably only along a length of approx. 1/32 inch to approx. 1/2 inch, for example, approx. 1/16 inch to approx. 1/4 inch. In addition the elastomeric polymer material can be located across the entire width of press felt 1.

In order to improve the compression elasticity and the damping characteristic in the seam region elastomeric polymer material 11 can have a foam structure, for example, especially a closed cellular foam structure. This is, for example, possible if during production of the liquid polymer or pre-polymer $CO_2$ is added which forms gas bubbles in the cured elastomeric polymer material.

In the illustrated embodiment the elastomeric polymer material extends, viewed in the direction of the thickness of the press felt, only from machine side 6 into base structure 2. Generally, in order to improve the reduction of the marking tendency in the seam region, elastomeric polymer material 11, viewed in direction of thickness d of press felt 1 may not extend through to paper side 12 of press felt 1.

Moreover, located on base structure 2 is paper side fibrous nonwoven structure 13 which provides paper side 12 of press felt 1 and which can be formed, for example, by top fibrous nonwoven layer 14 and middle fibrous layer 15 which is located between base structure 2 and top fibrous nonwoven layer 14, whereby top fibrous nonwoven layer 14 is formed from finer fibers than middle fibrous nonwoven layer 15.

Paper side fibrous nonwoven structure 13, viewed in longitudinal direction MD of press felt 1, has one end section 16 and one other end section 17, between which paper side fibrous nonwoven structure 13 extends. In the illustrated example of the created endless condition of press felt 1, two end sections 16, 17 of paper side fibrous nonwoven structure 13 abut each other, whereby one of the two end sections of paper side fibrous nonwoven structure 13—in the current example end section 17—viewed in longitudinal direction MD of press felt 1 covers pass through opening 9.

In the illustrated embodiment, elastomeric polymer material 11 is located only on two end sections 20, 21 of machine side fibrous nonwoven structure 6, viewed in longitudinal direction MD of press felt 1, without extending into the region of passage opening 9 which is created by seam loops 7, 8. In addition, viewed in longitudinal direction MD of press felt 1 elastomeric polymer material 1 in machine side fibrous nonwoven structure 6 does not extend in a region between two end sections 20, 21.

In the region of each of two seam loops 7, 8 there is also at least one filler thread 22, 23 located between cross threads 19 which are interwoven with longitudinal threads 18 and passage opening 9 which is created by seam loops 7,8. The filler thread extends parallel to cross threads 19 and is embedded, at least partially, into elastomeric polymer material 11 and is in its structure and material different than cross threads 19 of base structure 2.

What is claimed is:

1. An endless press felt for use in one of a paper machine, cardboard machine and tissue machine, said endless press felt comprising:

an open, load-carrying base structure, said base structure having a first end and a second end when viewed in a longitudinal direction of the press felt, said first end including first seam loops and said second end including second seam loops, said first seam loops being configured to be intermeshed with said second seam loops to form a pass through opening;

a pintle configured to be guided through said pass through opening;

a machine side fibrous nonwoven structure positioned on said base structure, said machine side fibrous nonwoven structure having one end section and a second end section when viewed in said longitudinal direction, wherein when viewed in said longitudinal direction said first seam loops and said second seam loops extend at least partially over said first section and said second section; and an elastomeric polymer material comprised of one of a polymer and a pre-polymer which is added in liquid form into the press felt and subsequently one of solidified and cured, said elastomeric polymer extending in at least one of said first end section and said second end section from said machine side fibrous nonwoven structure into said base structure and said elastomeric polymer not extending to said pass through opening.

2. The press felt according to claim 1, wherein said elastomeric polymer extends in said at least one of said first end section and said second end section over a length of up to approximately 2 inches when viewed in said longitudinal direction.

3. The press felt according to claim 2, wherein said elastomeric polymer extends in said at least one of said first end section and said second end section over a length of up to approximately 1 inch when viewed in said longitudinal direction.

4. The press felt according to claim 3, wherein said elastomeric polymer extends in said at least one of said first end section and said second end section over a length of up to approximately ½ inch when viewed in said longitudinal direction.

5. The press felt according to claim 4, wherein said elastomeric polymer extends in said at least one of said first end section and said second end section over a length of up to approximately ¼ inch when viewed in said longitudinal direction.

6. The press felt according to claim 5, wherein the press felt is configured to move in a transport direction parallel to said longitudinal direction and one of said first section and said second section is a back section when viewed in said longitudinal direction, wherein said elastomeric polymer material is in said back section.

7. The press felt according to claim 6, wherein said elastomeric polymer material is in said first section and said second section of said machine side fibrous nonwoven structure.

8. The press felt according to claim 7, further comprising a paper side fibrous nonwoven structure on said base structure.

9. The press felt according to claim 8, wherein said paper side fibrous nonwoven structure includes one end section and one other end section, said one end section being configured to abut said other end section and one of said one end section and said other end section configured to overlap said pass through opening when viewed in said longitudinal direction.

10. The press felt according to claim 9, said fibrous nonwoven structure comprising a plurality of fibers and said base structure comprising plurality of threads, wherein said plurality of fibers and said plurality of threads are at least partially embedded in said elastomeric polymer material.

11. The press felt according to claim 10, wherein said elastomeric polymer material on said at least one of said first section and said second section of said machine side fibrous nonwoven structure partially fills and or bridges at least one of spaces between said plurality of fibers and other spaces between said threads.

12. The press felt according to claim 11, wherein said elastomeric polymer material is on an entire width of the press felt.

13. The press felt according to claim 12, wherein said elastomeric polymer material has a foam structure.

14. The press felt according to claim 13, wherein said foam structure is a closed cellular foam structure.

15. The press felt according to claim 14, wherein said base structure further comprises longitudinal threads configured to form said first seam loops and said second seam loops and cross strengthening elements joined with said longitudinal threads, said longitudinal threads not being joined in a region of said first seam loops and said second seam loops and being joined in a region outside of said first seam loops and said second seam loops.

16. The press felt according to claim 15, said cross strengthening elements further comprising a plurality of cross threads, wherein at least one filler thread having at least one of a different structure and material from said cross threads which extends parallel to said cross threads when viewed in said longitudinal direction, said filler thread being configured to be interwoven with said longitudinal threads and said pass through opening.

17. The press felt according to claim 16, wherein said at least one filler thread is at least partially embedded in said elastomeric polymer material.

18. The press felt according to claim 17, wherein said elastomeric polymer material is a moisture hardening prepolymer which cures or hardens during cross-linking.

19. The press felt according to claim 18, wherein said elastomeric polymer material includes at least one of polyurethane and polycarbamide.

20. The press felt according to claim 19, further comprising a second elastomeric polymer material in said paper side fibrous nonwoven structure, said second elastomeric polymer material extends in a region of at least one of said first section and said second section of said paper side fibrous nonwoven structure when viewed in said longitudinal direction and does not extend into a region of said pass through opening.

21. The press felt according to claim 20, wherein said second elastomeric polymer material does not extend through to a paper side of said press felt viewed in a direction of a thickness of the press felt.

* * * * *